United States Patent [19]

Hillock et al.

[11] Patent Number: 5,036,736

[45] Date of Patent: Aug. 6, 1991

[54] METHOD AND APPARATUS FOR MAR FREE HANDLING OF SHEET STEEL

[76] Inventors: Ronald A. Hillock, 47611 Lexington, Utica, Mich. 48087; Steven B. Ross, 28459 Floral, Roseville, Mich. 48066

[21] Appl. No.: 478,628

[22] Filed: Feb. 12, 1990

[51] Int. Cl.[5] ..... B23Q 7/04

[52] U.S. Cl. ..... 83/23; 83/24; 83/94; 83/100

[58] Field of Search ..... 83/94, 84, 24, 23, 86, 83/100, 98, 402

[56] References Cited

U.S. PATENT DOCUMENTS

| | | | |
|---|---|---|---|
| 3,672,250 | 6/1972 | Creffield | 83/92 |
| 4,012,275 | 3/1977 | Stöholm et al. | 156/515 |
| 4,709,605 | 12/1987 | Clark | 83/23 |

FOREIGN PATENT DOCUMENTS

| | | | |
|---|---|---|---|
| 0216937 | 10/1985 | Japan | 83/84 |
| 191581 | 12/1937 | Switzerland | 83/100 |
| 1465196 | 3/1989 | U.S.S.R. | 83/100 |

*Primary Examiner*—Mark Rosenbaum
*Assistant Examiner*—John M. Husar
*Attorney, Agent, or Firm*—John R. Benefiel

[57] ABSTRACT

An apparatus and process for mar free handling of sheet steel pieces and blanks die cut therefrom in a press, in which load and unload trolleys are used with vacuum pickup and transport of the sheet steel piece and blanks from respective locations at the front and rear of the press. A pusher slides the sheet steel pieces off a low friction platform at the front of the press and onto a non scuffing but smooth and soft bed liner, and the cut blank is raised with the die by an array of vacuum cups each partially recessed into the die board. A table is extendible from the rear of the press to be positioned beneath the die and receive the blank thereafter released from the die cavity. The table is retracted to allow pick-up therefrom by the unload trolley.

6 Claims, 2 Drawing Sheets

METHOD AND APPARATUS FOR MAR FREE HANDLING OF SHEET STEEL

BACKGROUND OF THE INVENTION

This invention concerns handling of sheet metal pieces incidental to loading and unloading of the pieces into and out of a die cutting press. There has heretofore been developed a steel rule die cutting technique for cutting out blanks from steel sheet material for subsequent forming from the blanks of auto body parts such as fenders, doors, etc.

Steel rule dies have significant advantages over machined or forged dies since they may be made at greatly lower cost and allow changes and corrections to be easily made. The trend to lower volume production runs has increased the use of steel rule dies in the production of blanks.

The forming of auto body parts requires a mar free surface of the sheet steel blank, as scratches seriously affect the appearance of the finished part, and require it to be scrapped.

There has existed a need for a low cost automated part handling process and system for use with steel rule die cutting of sheet metal blanks which would avoid marring the surface of the blanks.

SUMMARY OF THE INVENTION

The present invention comprises a process and apparatus for feeding sheet stock and removing blanks for a steel rule die cutting press, in which each piece is lifted from a loading stock by a suction cup array mounted on an elevating frame carried by an overhead loading trolley, and transferred to a low friction platform located on one side of the press. The low friction platform is provided by a roller or air film arrangement to allow non marring sliding of a sheet metal piece.

A pusher is activated to slide the deposited sheet stock piece across the surface thereof and onto a non-marring press bed liner in the press. The bed liner is sufficiently wear resistant to provide a scuff resistant surface to remain smooth after many pieces have been slid across the same but soft enough to prevent scratching of the surface of the sheet steel pieces. A Kevlar (TM) coated paper board material has been found satisfactory for this purpose.

The steel rule die is formed with an array of suction cups recessed into the die board so as to be compressed onto the upper surface of the blank forced into the die cavity as the blank is cut from the sheet stock piece. A vacuum applied at the same time causes the blank to be raised with the die as the press upper platen is raised, allowing the selvage to be removed.

An unload table is then moved into the press beneath the die and the blank released as by removing the vacuum and applying positive pressure, to deposit the same onto the unload table, which is then withdrawn. A suction disc platform carried by an unload trolley then descends to grasp the blank which is then elevated and transferred to an unload point.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
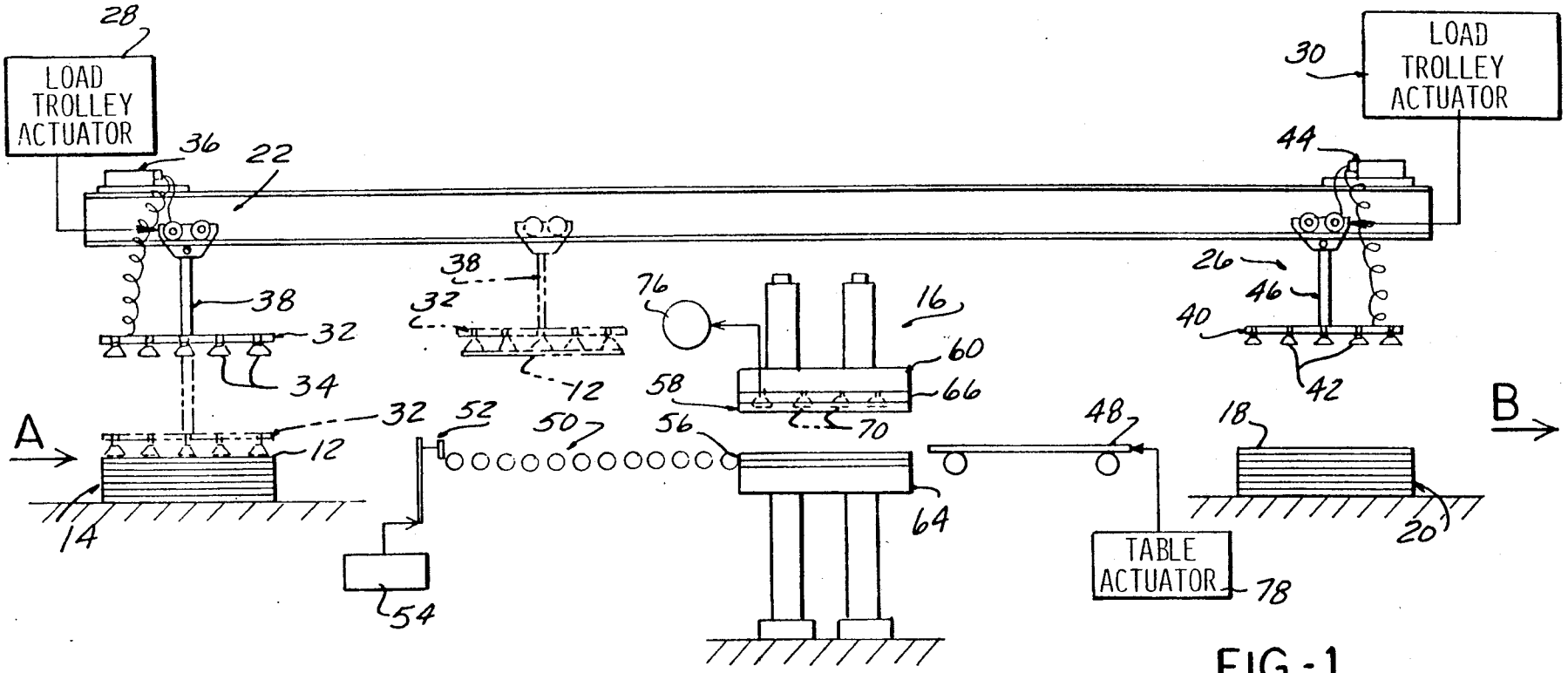
FIG. 1 is a diagrammatic representation of the process and apparatus according to the present invention shown with a sheet stock piece being removed from a stock of pieces at a load point.

Referring to the drawings, and particularly FIG. 1, the process and apparatus 10 according to the present invention are concerned with transferring pieces 12 of sheet stock from a stock at a loading point "A" into a die cutting press 16, and transferring die cut blanks 18 from the press 16 to a stock 20 at an unload point "B".

The apparatus 10 includes a loading trolley 22 mounted for rolling movement along an overhead rail 24 extending between the loading point "A" and the front of the press 16, and an unloading trolley 26 mounted for rolling movement along a section of the rail 24 between the unload point "B" and the rear of the press 16.

The load trolley 22 is moved between the end points of its travel by an actuator 28, such as an air operated cylinder, while the unload actuator 26 is similarly moved by an unload actuator 30.

The load trolley 28 carries a frame 32 mounting a planar array of vacuum cups 134, a vacuum being able to be selectively applied from a vacuum source, such as a motor-vacuum pump package 36.

The unload trolley 26 similarly carries a frame 40 mounting a planar array of suction cups 42, with vacuum being able to be selectively applied as by means of a motor vacuum pump package 44. The frame 40 is also able to be selectively raised and lowered as by means of a power cylinder 46 to bring the vacuum cups into engagement with the blank 18 on a transfer table 48.

Figure 2:
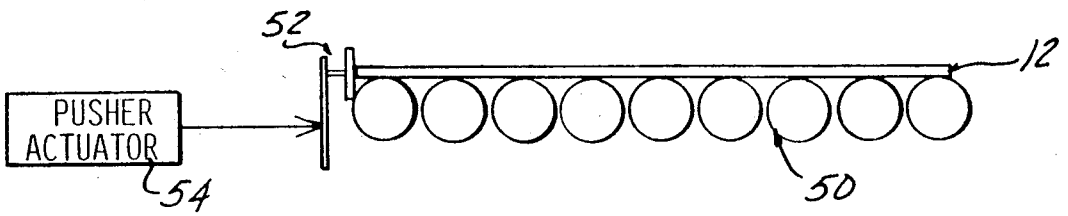
FIG. 2 is a view of a portion of the process and apparatus shown in FIG. 1, with a sheet stock piece being loaded onto the low friction platform.
Figure 3:
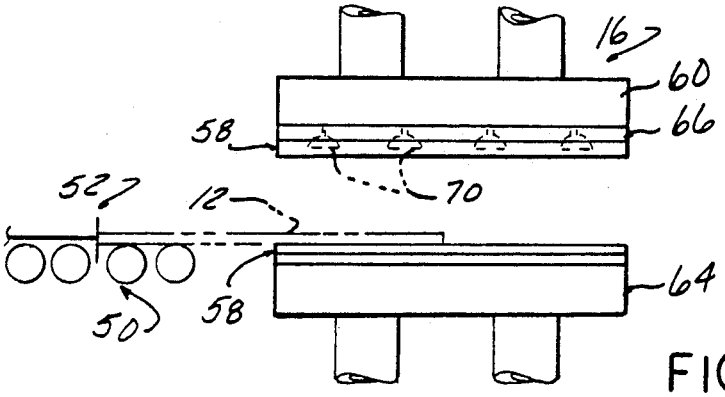
FIG. 3 is a view of a portion of the apparatus and process shown in FIG. 1 with a sheet stock piece being transferred onto the press.
Figure 5:
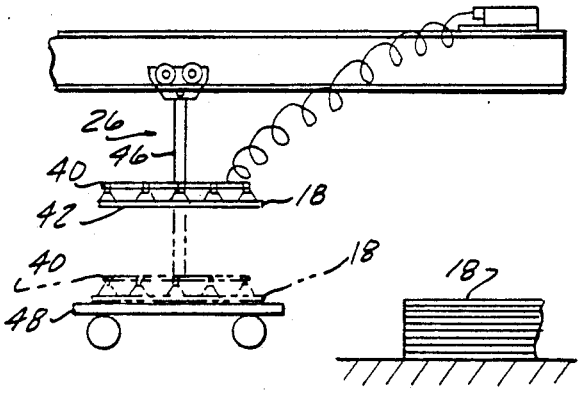
FIG. 5 is a view of a portion of the apparatus and process shown in FIG. 1 with a die cut blank being transferred to an unload point.

The loader trolley 22 is initially positioned over the stack 12, and the cylinder 38 actuated to cause the vacuum cups 34 to descend and engage the upper surface of a sheet stock piece 12, the vacuum pump motor 36 activated to cause suction gripping of the piece 12, the cylinder 38 thereafter again activated to raise the piece 12. The trolley actuator 28 thereafter causes the trolley 22 to traverse towards the press 16, and stops over a low friction platform 50, with the vacuum released and positive pressure applied to release the stock piece 12 which drops onto the low friction platform 50, as shown in FIG. 2.

The low friction platform 50 may comprise an array of rollers as indicated, or a gas film surface may be established to enable friction free sliding movement of a sheet stock piece 12 deposited thereon. Such movement is accomplished by a pusher 52 advanced by an actuator device 54, such as an air cylinder, which pushes a piece 12 into the press 16, sliding across a bed liner 56 to be positioned beneath a steel rule die 58 mounted to the upper platen 60 of the press 16.

Figure 6:
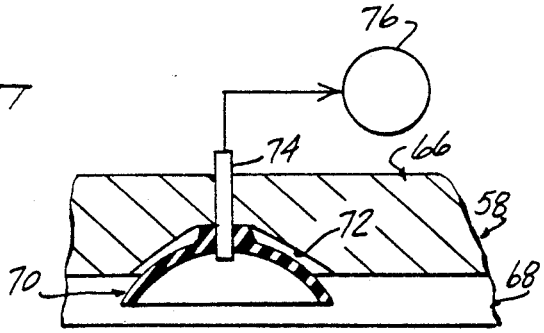
FIG. 6 is an enlarged fragmentary view of the steel rule die, illustrating the installation therein of suction cups.

The bed liner 56 is positioned atop a steel cutting plate 62 (FIG. 6) sitting on the lower platen 64 of the press 16. The composition of the bed liner 56 is important, as this material must resist scuffing as successive sheet stock pieces 12 are slid across the same, and remain smooth while being sufficiently soft so as to avoid making scratches in the pieces 12. A suitable material has been found to be KEVLAR TM fibre layer embedded in and bonded by an epoxy adhesive to a paper board backing. This material will resist scuffing and not scratch the surface of sheet steel pieces 12 being slid across the surface thereof.

The steel rule die 58 comprises a backing board 66 having a formed pattern of steel rule 68 inserted in slots in the manner well known in the art.

The construction of the backing board may be described in detail in copending application Ser. No. 07/347,572, filed on May 5, 1989 now U.S. Pat. No. 4,981,061.

According to one aspect of the present invention the die board 66 has a downwardly facing array of vacuum cups 70 mounted within the cavity defined by the die rule 68, recessed within counterbores 72 machined into the die board 66. The counterbores 72 accommodate flattening of the vacuum cups 70 as the disc 58 is advanced into the sheet piece 12, and a vacuum is drawn via tubes 74 and vacuum source 76 when the press 16 is cycled, so that the blank 18 is retained within the die cavity when the press platens 60, 64 are supported.

The selvage may be removed manually, as by using tongs or a vacuum tool.

Figure 4:
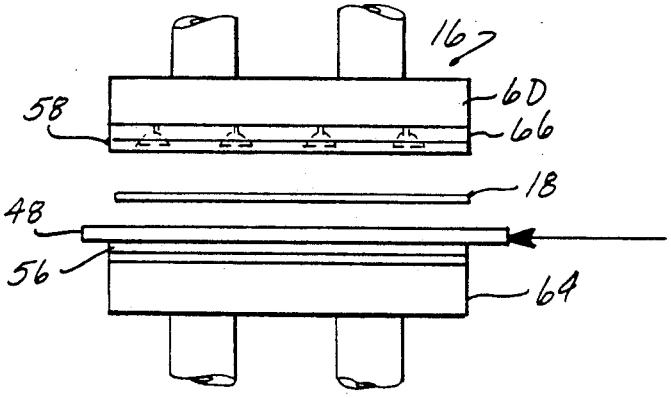
FIG. 4 is a view of a portion of the apparatus and process shown in FIG. 1 with a die cut blank being removed from the press.

Thereafter, the unload table 48 is advanced into the press 16, by operation of a table actuator 78, as shown in FIG. 4, and the vacuum released and positive pressure applied to discharge the blank 18 onto the table 48.

The table 48 is then withdrawn, and the platform 40 lowered to engage the vacuum cups 42 with the upper surface of the blank 18, the vacuum applied to the same time, to allow the blank 18 to be gripped and elevated as the platform 40 is raised. The unload trolley 26 is then advanced to the unload point "B" the platform 40 lowered, and the vacuum released to drop the blank 18 onto a stack at the unloading point "B".

We claim:

1. Apparatus for handling sheet steel pieces in conjunction with steel rule die cutting of blanks in a press having upper and lower platens, said apparatus comprising:

a load trolley, guide rail means on which said load trolley is mounted for movement, said guide rail means above said press extended between a load point remote from said press and a location at the front of said press, said load trolley carrying a frame and means for selectively attracting one of said sheet steel pieces to said frame to be held thereagainst, said load trolley also having means for raising and lowering said frame, and an actuator for powering said load trolley on said guide rail means;

a low friction platform located at the front of said press to receive a sheet steel piece released from said frame with said load trolley positioned thereover, said platform having an upper side provided with antifriction means to enable substantially friction free sliding of said sheet steel pieces thereacross;

selectively operated pusher means for pushing a sheet steel piece on said platform into said press;

said press including a bed liner located on said lower platen of said press onto which said sheet steel piece is pushed by said pusher means, said bed liner having a soft non-scuffing surface able to withstand numerous instances of sliding said sheet steel pieces thereacross without scuffing and smooth enough to not scratch said sheet steel piece slid thereacross;

a steel rule die mounted on said upper platen of said press, including a die board and a steel rule fixed in said die board in a pattern corresponding to the shape of said blank;

a series of vacuum cups mounted to the downward facing side of said die board within said steel rule patter and vacuum means for selectively applying a vacuum to said vacuum cups;

an unload table mounted to be extended into said press above said bed liner and below said steel rule die with said upper and lower platens separated, said table able to be retracted to a location on the rear of said press;

an unload trolley and guide rail means above said press on which said unload trolley is movably mounted extended from said location as the rear of said press to an unload point remote from said press, said unload trolley carrying a frame and means for attracting a blank to said frame to be held thereagainst, said unload trolley also having means for raising and lowering said frame and an actuator for powering said unload trolley on said guide rail means, whereby said load trolley can be powered on said guide rail means to be positioned over said load point, said frame lowered to engage said means for attracting a sheet steel piece to pick up a sheet steel piece, said frame may be raised to also raise said sheet steel piece, said load trolley powered on said guide rail means to said location at the front of said press, said sheet steel piece released onto said low friction platform said sheet steel piece pushed onto said bed liner and a blank cut by cycling of said press, with said cut blank held in said die cavity by said vacuum cups as said upper platen is raised, said table extended into said press to receive said blank when released from said die cavity, said table thereafter retracted to said location at the rear of said press, said unload trolley over said location able to lower said frame and pick up said blank, raise and transfer the same to said unload point.

2. The apparatus according to claim 1 wherein said bed liner comprises a member covered with KEVLAR material.

3. The apparatus according to claim 1 wherein said vacuum cups are partially recessed into said die board.

4. The apparatus according to claim 1 wherein said low friction platform comprises an array of rollers.

5. The apparatus according to claim 1 wherein said means for attracting said sheet steel pieces and blanks to said frame on said load and unload trolleys respectively comprises an array of vacuum cups and means for selectively applying a vacuum to said vacuum cups.

6. A process for handling sheet steel pieces and blanks die cut therefrom in a press, said process including the steps of:

stacking sheet steel pieces at a load point remote from said press;

lowering a frame against the top sheet steel piece in said stack and attracting the top sheet steel piece to said frame to be held thereon;

raising and transporting the frame and said sheet steel piece to a location at the front of said press;

depositing said piece onto a low friction platform at said location;

pushing said sheet steel piece into said press to be slid onto a smooth bed liner on a lower platen of said press;

attracting said blank into the disc cavity of said die to raise said cut blank with the upper platen of said press as said platen is raised after cutting of said blank;

inserting a table into said press beneath said die and releasing said blank thereonto;

retracting said table to a location at the rear of said press;

lowering a frame against said blank on said retracted table and attracting said blank to said frame to be held thereby;

raising and transporting said frame and said blank to an unload location remote from said press; and, releasing said blank to be deposited at said unload location.

* * * * *

UNITED STATES PATENT AND TRADEMARK OFFICE

CERTIFICATE OF CORRECTION

PATENT NO. : 5,036,736

DATED : August 6, 1991

INVENTOR(S) : Hillock et al

It is certified that error appears in the above-identified patent and that said Letters Patent is hereby corrected as shown below:

Column 2, line 44, "134" should be --34--.

Column 3, line 44, "to" should be --at--.

Column 3, line 57 (Claim 1), "extended" should be --extending--.

Column 4, line 21 (Claim 1), "patter" should be --pattern--.

Column 4, line 30 (Claim 1), "extended" should be --extending--.

Signed and Sealed this

Twelfth Day of January, 1993

*Attest:*

DOUGLAS B. COMER

*Attesting Officer*

*Acting Commissioner of Patents and Trademarks*